US005433638A

United States Patent [19]

Nanba

[11] Patent Number: 5,433,638

[45] Date of Patent: Jul. 18, 1995

[54] METHOD OF AND APPARATUS FOR MANUFACTURING GETTER-CONTAINING VACUUM TUBE

[75] Inventor: Kunitaka Nanba, Gifu, Japan

[73] Assignee: Sony Corporation, Tokyo, Japan

[21] Appl. No.: 267,676

[22] Filed: Jun. 29, 1994

[30] Foreign Application Priority Data

Jun. 30, 1993 [JP] Japan ..... 5-189015

[51] Int. Cl.[6] ..... H01J 9/39

[52] U.S. Cl. ..... 445/6; 445/55; 445/62

[58] Field of Search ..... 445/6, 41, 55, 62, 63, 445/70, 73

[56] References Cited

U.S. PATENT DOCUMENTS 2,838,708 6/1958 Yoder ..... 445/6

3,372,968 3/1968 Grimes ..... 445/62

4,881,914 11/1989 Kamp et al. ..... 445/55

FOREIGN PATENT DOCUMENTS 2-79325 3/1990 Japan ..... 445/6

*Primary Examiner*—Mark Rosenbaum

*Assistant Examiner*—Jeffrey T. Knapp

*Attorney, Agent, or Firm*—Hill, Steadman & Simpson

[57] ABSTRACT

A method of manufacturing a getter-containing CRT is disclosed which permits the getter flash process time to be reduced without posing any problem such as melting of getter container that might otherwise result from excessive temperature increase and thus productivity can increase. In a process of thermally flashing of the getter material, the temperature rise slope is reduced after reaching of the flash start temperature of the getter material.

8 Claims, 9 Drawing Sheets

METHOD OF AND APPARATUS FOR MANUFACTURING GETTER-CONTAINING VACUUM TUBE

BACKGROUND OF THE INVENTION

1. Field of the Invention

This invention relates to a method of and an apparatus for a getter-containing vacuum tube. More specifically, the invention concerns a method of manufacturing a getter-containing vacuum tube, which permits reduction of the time of manufacture. The invention can be utilized as a method of manufacturing cathode-ray tube (hereinafter also referred to as CRT) to be used for various purposes.

2. Related Arts

The getter has been used in the CRT for adsorbing gases in the tube.

In the usual manufacturing process, a getter (many getters being mainly composed of Ba), which is mounted inside the tube, is heated to about 800° C. or above by externally applied high frequency power for flashing.

The general technique concerning the getter-containing vacuum tube will now be described with reference to FIGS. 4 and 5.

As shown in FIG. 4, inside a CRT 1 a getter 2 is supported by a getter spring 12 which is mounted on the inner surface of the back of a tube 10. Designated at 11 is an anode button, and at 13 a projection. Designated at 14 is a screen formed on the inner surface of the front face of the tube 10. On the screen 14, an image is formed by electrons shot from an electron gun 15. Designated at 16 is a conductive layer.

FIGS. 5A to 5C illustrate the principles, under which the getter 2 captures gases inside the CRT 1 to maintain a degree of vacuum. Specifically, heating means 3 (usually a high frequency induction heating coil) is provided outside the CRT 1 (FIG. 5A). The getter 2 is heated by the heating means 3 to 700° to 1,200° C. in case when the getter 2 is mainly composed of Ba, thus causing spattering and deposition of Ba (FIG. 5B). In this way, a Ba film 21 is formed on the inner wall surface of the tube. When the gas is spattered, inner gases are absorbed. More specifically, Ba absorbs oxygen and nitrogen (and also gases composed of these elements) in the CRT 1 in the form of oxides and nitrides. For example, it reacts with and absorbs $O_2$, CO, $CO_2$, etc. generated during the duty operation of the CRT, thus maintaining a degree of vacuum. In addition, it has an effect of removing oxides of carbon having adverse effects on the cathode. (The oxides of carbon are thought to reduce the life of the cathode, for instance with conversion of $CO_2$ into $CH_4$).

What is used as the getter 2 is typically mainly composed of Ba. For example, it is possible to use a getter composition, which comprises $BaAl_4$ and Ni in a part-by-weight ratio of 50:50 and contains, if necessary, 0 to 4.8 parts by weight of $Fe_4N$. When this getter is heated to about 800° C., a reaction represented as $$BaAl_4+4Ni=>Ba+4NiAl$$

is brought about, whereby spattered Ba has an effect of absorbing gases to maintain a degree of vacuum.

To capture gases by spattering the getter in the above way is referred to as getter flash. In the process of the CRT manufacture, it is desired to reduce the time required for the getter flash process.

In order to reduce the process time, it is important how to reduce the heating time until a sufficient amount of spatter is secured after the start of the getter flash.

As noted above, in the usual technique the getter mounted inside the CRT is externally heated by a high frequency coil to about 800° C. to cause reaction between Ni and Al so as to cause Ba to flash. When flashed, Ba has an effect of absorbing gases generated in the CRT to maintain a vacuum degree thereof. It is thought that the life of the CRT is longer the greater the amount of Ba.

Investigations conducted by the inventor reveal a certain period of time is necessary to secure a predetermined spattering amount of getter, i.e., Ba. FIG. 6 shows a temperature rise curve I′ in a getter flash process. In the graph, the ordinate is taken for temperature, and the abscissa for time. Indicated by ST on the abscissa is the flash start time, and by TT the getter (i.e. Ba) spattering securement time. It was found by the inventor that the getter spattering securement time TT is a function of the flash start time ST.

It is thought to be possible to reduce the getter spattering securement time TT by reducing the flash start time ST. To reduce the flash start time ST, however, it is necessary to increase the RF output of a high frequency heating coil as heating means. The getter is usually held in a SUS or like container. Therefore, by suddenly increasing temperature for reducing the flash start time ST, a melt temperature, at which the container is melted (i.e., 1,400° C. in SUS) is reached before the reaching of the getter spattering securement time TT, as labeled at V in FIG. 6. That is, the container is melted.

Generally, the heating temperature and the high frequency (RF) output are related as shown by curve A in FIG. 7, the heating temperature being increased in proportion to the high frequency output.

It was found as a result of investigations conducted by the inventor that by carrying out the heating for long time with the high frequency (i.e., RF) output held constant, a peak is produced at a certain predetermined temperature, as shown by curve B in FIG. 7.

The relation between the container melt and the temperature is as shown by curve C in FIG. 9. As shown, the container which comprises SUS is melted when the temperature is increased beyond 1,400° C.

Specifically, as shown in FIG. 10, by increasing the RF output as shown by curve IV for reducing the process time with respect to the usual output RF temperature increase curve as shown by curve III, the melt temperature is reached to result in melting within the getter spattering securement time TT.

SUMMARY OF THE INVENTION

An object of the invention, which has been intended to solve the above problems, is to provide a method of manufacturing a getter-containing vacuum tube, which permits reduction of the getter flash process time without such problem as melting, thus realizing productivity improvement.

To attain the above object, according to the invention as claimed in claim 1, there is provided a method of manufacturing a getter-containing vacuum tube, in which a process of causing thermal flashing of the getter material is carried out with the temperature rise slope reduced after reaching the flash start temperature by the getter material.

Also, to attain the above object according to the invention as claimed in claim 2 there is provided a method of manufacturing a getter-containing vacuum tube according to claim 1, in which a two-step heating process is carried out, a first step of heating being carried out until reaching of the flash start temperature of the getter material, a second step of heating being carried out after reaching of the flash start temperature of the getter material.

According to the invention the getter material may comprise Ba as main component and suitably contain an alloy containing Al and Ni (e.g., Ba:Ni:Al=50:25:25) and also such elements as Ma, Ca; Sr, Zr, Ti, Ta, Th, etc.

According to the invention the getter material is heated fast until reaching of the its flash temperature and, after reaching of the flash temperature, it is heated with a reduced temperature rise slope. It is thus possible to preclude the problem that a temperature, at which such problem as the melting of the container arises, is reached before the necessary flash amount is secured. Thus, according to the invention the getter flash process time can be reduced without the problem of the melting, and it is thus possible to realize productivity improvement.

DETAILED DESCRIPTION OF THE PREFERRED EMBODIMENTS

Now, preferred embodiments of the invention will be described with reference to the drawings. It is to be construed that these embodiments are by no means limitative.

FIRST EMBODIMENT

In this embodiment, the invention is applied to the manufacture of a CRT containing a getter, which is composed of a Ba-Ni-Al alloy and is held in a SUS container.

Figure 1:
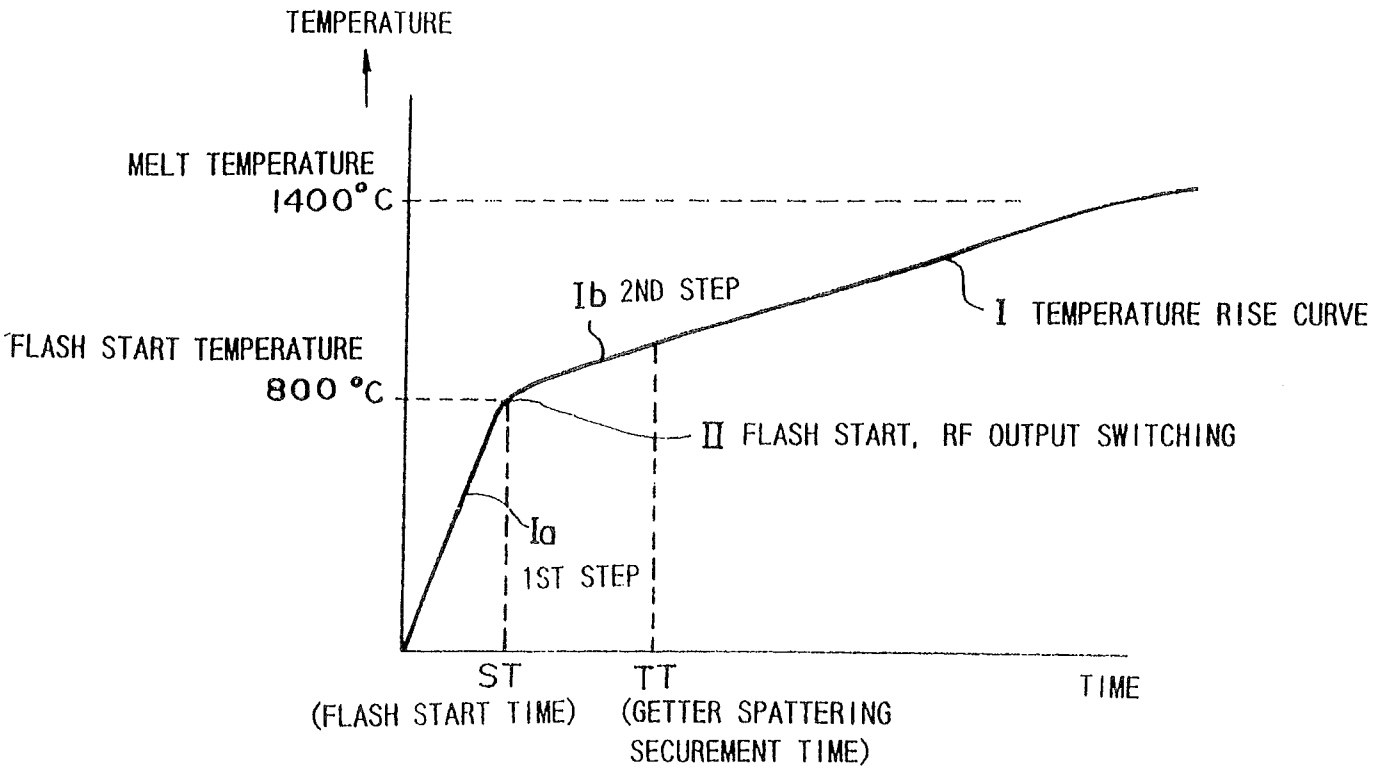
FIG. 1 is a graph showing a temperature rise curve in a flash process in a first embodiment of the invention.

FIG. 1 shows a temperature rise curve I in the flash process in this embodiment. As shown, the temperature rise slope is reduced as shown at Ib after reaching of the flash start temperature (i.e., 800° C. in this case) of the getter material.

Particularly, in this embodiment the heating process was carried out in two steps, i.e., a first step of heating until reaching of the flash start temperature of the getter material as shown at Ia and a second step of heating after reaching of the flash start temperature of the getter material as shown at Ib.

Consequently, it is possible to effect the heating in the first step Ia fast at a high temperature to reduce the process time, while switching, after the start of flash as shown at II, the RF output caused to flow through a coil as heating means so that the the container melt temperature is not reached until reaching of the getter spattering securement time TT. It was thus possible to reduce the process time while precluding the problem of melting.

The temperature rise time in FIG. 1 has straight portions for both the first and second steps Ia and Ib. However, it is of course possible to obtain satisfactory results with a curved plot with the slope thereof reduced gently.

Figure 2:
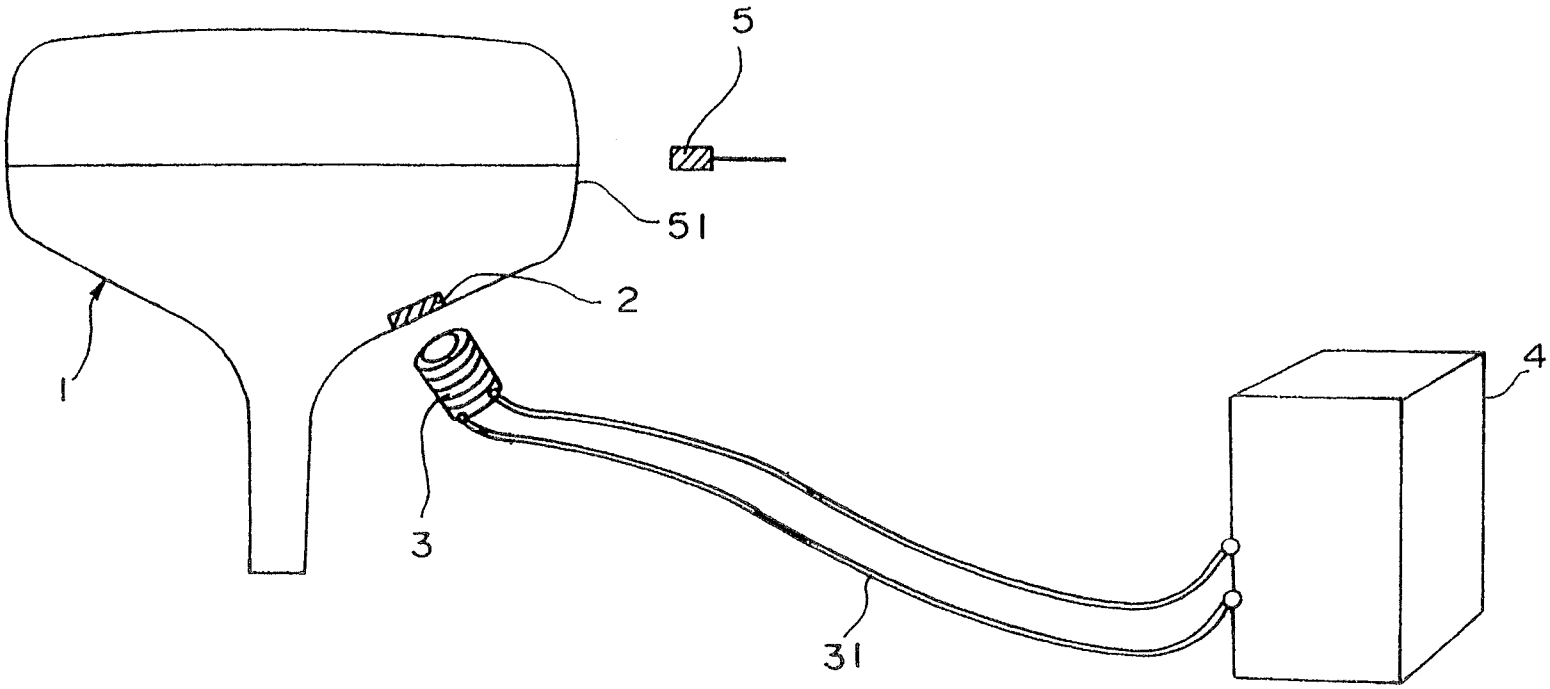
FIG. 2 is a schematic view showing a set-up used for the flash process in the first embodiment.

FIG. 2 schematically shows a set-up used for the flash process in this embodiment. In the process of manufacture, the getter 2 contained in the CRT 1 is heated externally by a high frequency heating coil as heating means 3. The heating means 3 (i.e., high frequency heating coil) is connected via a cable 31 to a high frequency oscillator 4. The high frequency oscillator 4 is capable of RF output switching by means of volume setting. Thus, at the time of transition from the step Ia to the step Ib (as shown at 11 in FIG. 1), the RF output is controlled by the high frequency oscillator 4 to reduce the temperature rise slope.

In FIG. 2, designated at 5 is an optical sensor, which detects light generation caused by the flashing of the getter 2 from light from, for instance, a position 51 as shown in the Figure. Thus, the optical sensor 5 can detect the flash start, and it feeds back this to provide an output switching signal. In addition, the optical sensor 5 can be constructed such that it detects the flash peak and effect control according to the detected flash peak.

While in this embodiment the getter alloy composed of Ba as effective component was used together with the SUS container, where it is not desired to heat the getter beyond a certain temperature before the securement of the necessary getter spattering, the invention is applicable as well by making various settings according to the getter composition and other conditions.

Further, while in this embodiment the RF output was switched to control the heating by the heating means 3 for the temperature rise curve control, it is possible to arrange such as to obtain temperature rise curve control by varying the distance between the coil or like heating means and the getter by moving the coil.

SECOND EMBODIMENT

Figure 3:
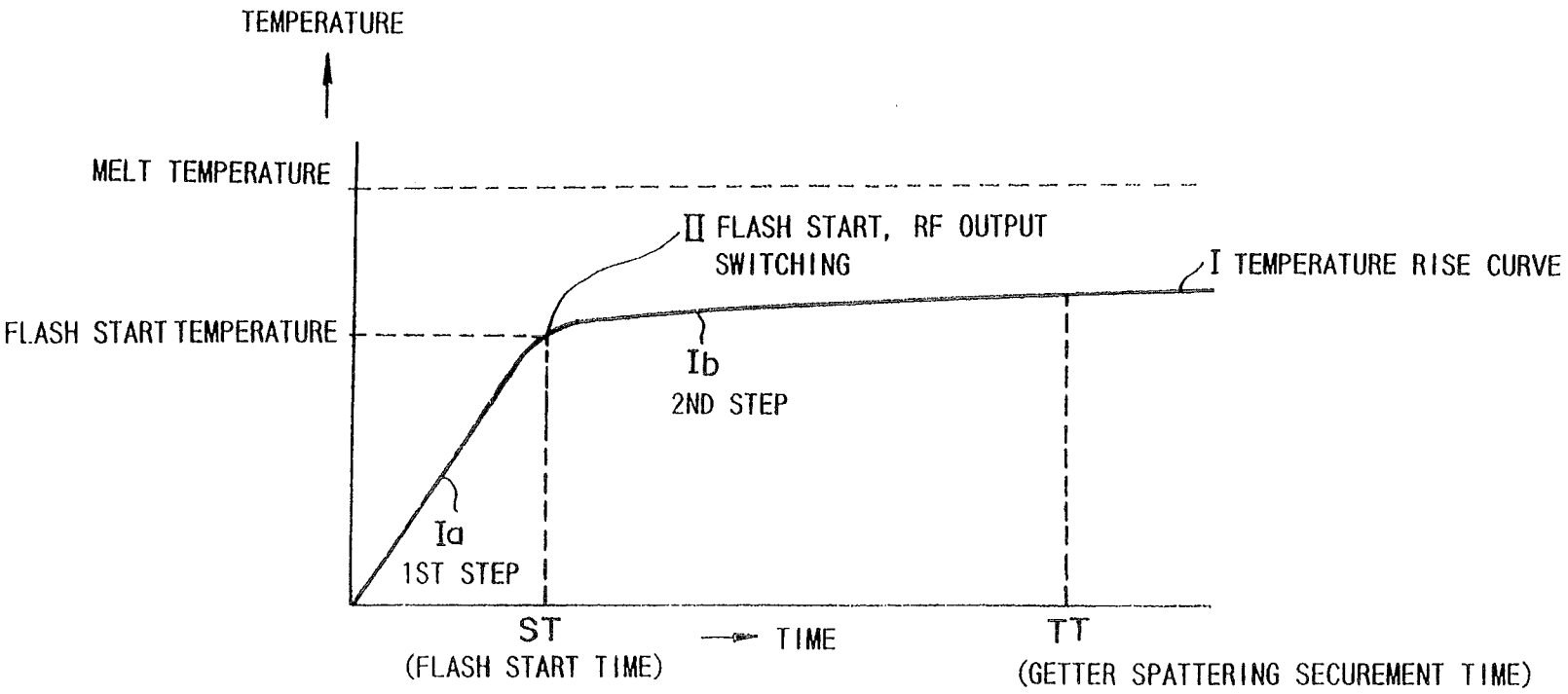
FIG. 3 is a view showing a temperature rise process in a flash process in a second embodiment of the invention.
Figure 4:
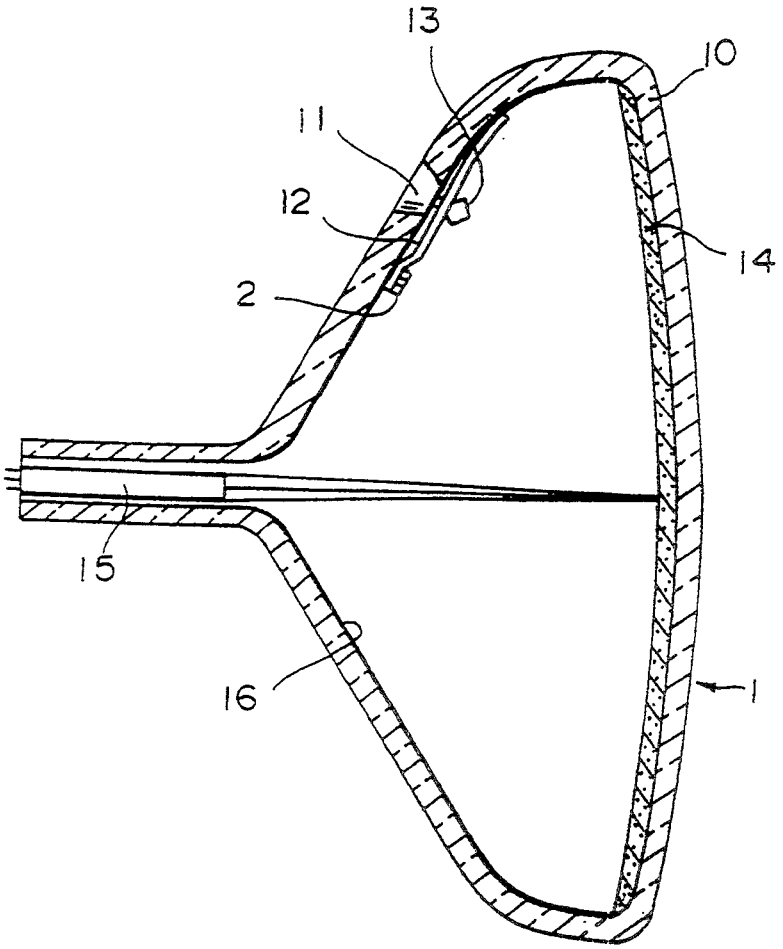
FIG. 4 is a sectional view showing a usual getter-containing CRT.
Figure 5A:
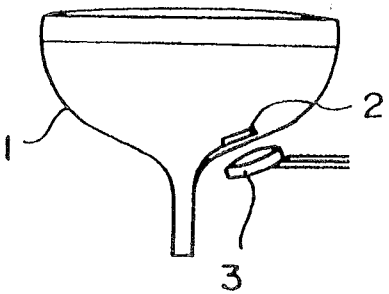
FIGS. 5(A) to 5(C) are views for explaining the getter function principals.
Figure 5B:
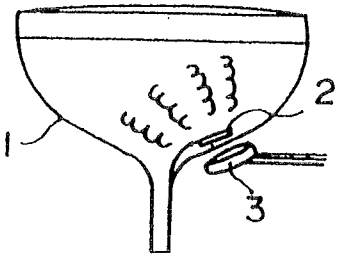
Figure 5C:
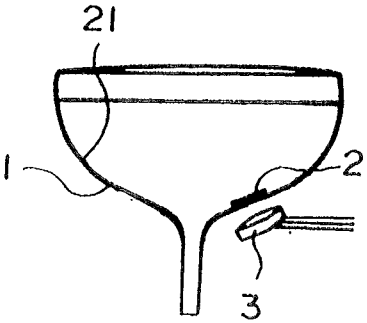
Figure 6:
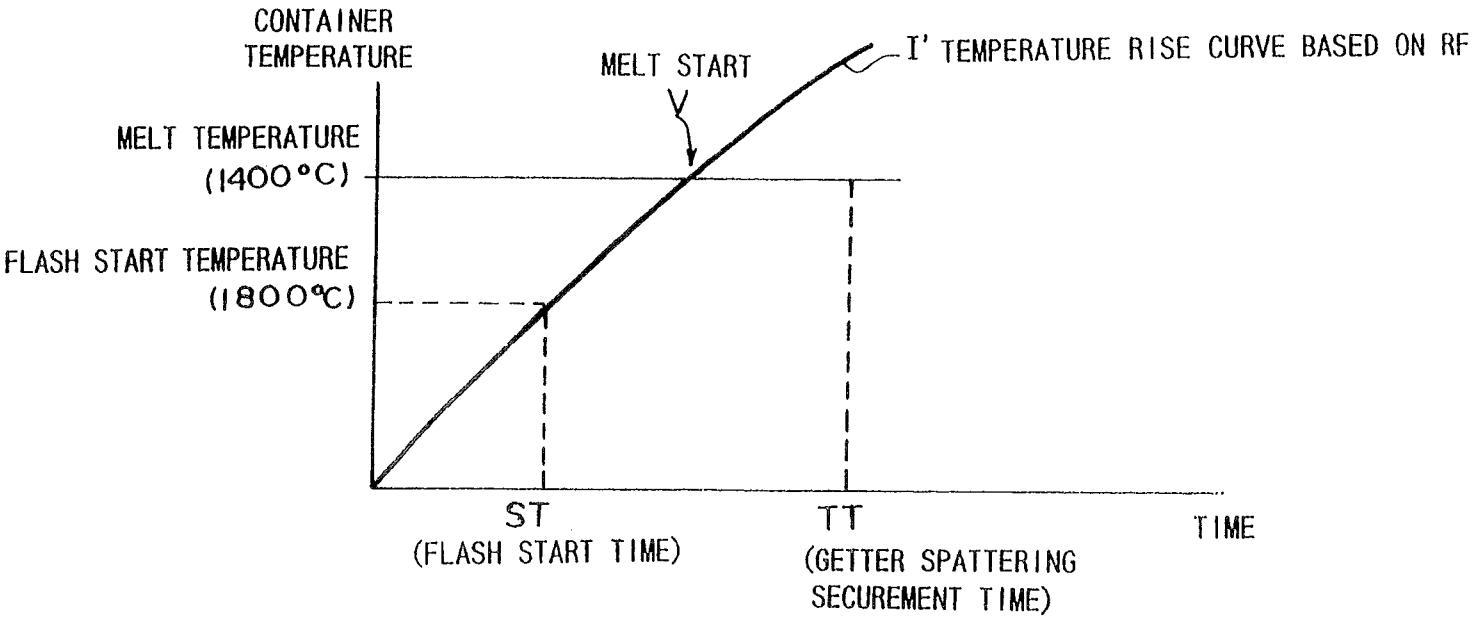
FIG. 6 is a graph illustrating a problem.
Figure 7:
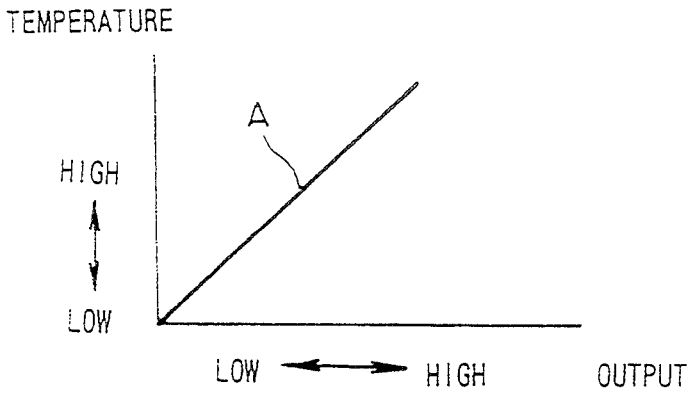
FIG. 7 is a graph illustrating the relation between temperature and RF output.
Figure 8:
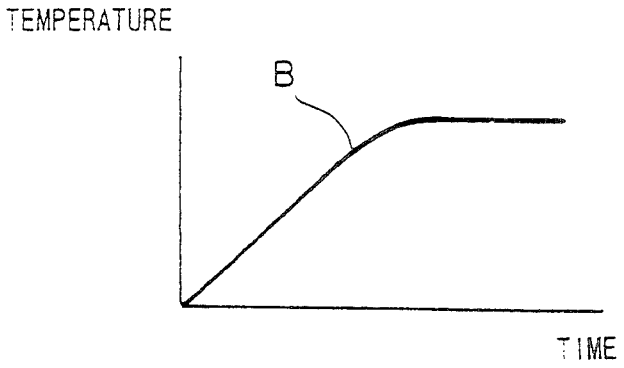
FIG. 8 is a graph illustrating the relation between temperature and RF time.
Figure 9:
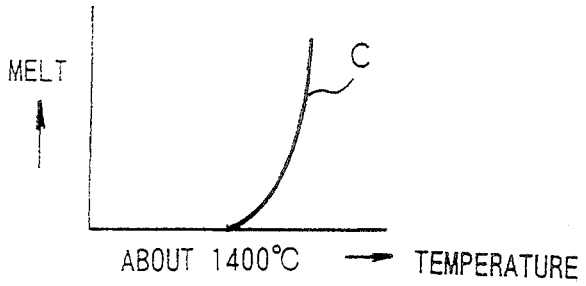
FIG. 9 is a graph illustrating the relation between container melt and temperature.
Figure 10:
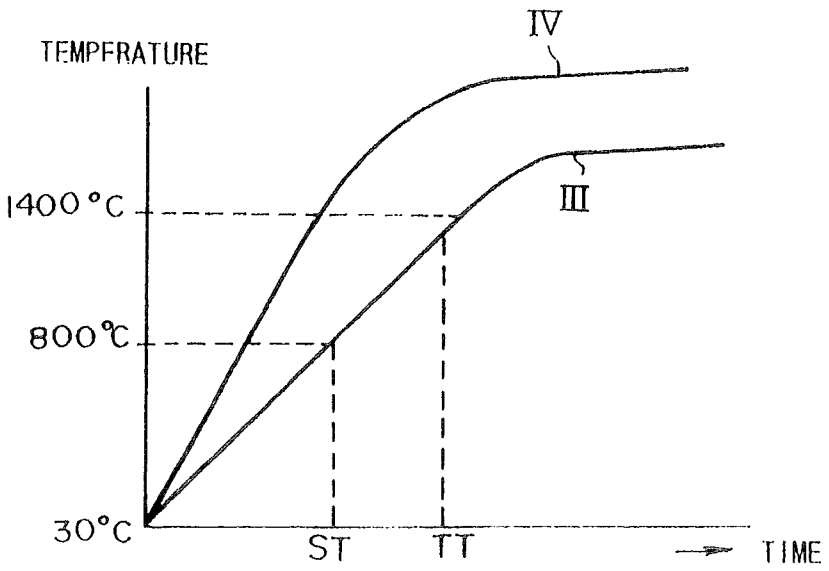
FIG. 10 is a graph for explaining problems.

In this embodiment, the flash process was carried out as in the first embodiment. In this instance, however, as shown in FIG. 3, the second step Ib of heating after the flash start 11 was carried out substantially at a constant temperature as shown by the temperature rise curve I. That is, the RF output was controlled to provide a slightly curved, gentle and almost flat temperature rise curve.

In this embodiment, the same effects as in the previous first embodiment are obtainable.

As has been described in the foregoing, according to the invention it is possible to reduce the getter flash process time without such problem as melting, realizing productivity improvement.

What is claimed is:

1. A method of manufacturing a getter-containing vacuum tube comprising the steps of:

heating a getter material at a first temperature rise slope sufficient to cause a thermal flashing of the getter material; and setting a second, reduced temperature rise slope to obtain sufficient spattering of the getter material after reaching of a flash start temperature thereof.

2. The method of manufacturing a getter-containing vacuum tube according to claim 1, wherein:

heating means output is switched to set a reduced temperature rise slope after reaching of the flash start temperature of the getter material.

3. The method of manufacturing a getter-containing vacuum tube according to claim 1, wherein:

the second slope is set to provide an almost flat temperature rise curve.

4. A method of manufacturing a getter-containing vacuum tube according to claim 1, wherein:

the vacuum tube is a cathode-ray tube.

5. An apparatus for manufacturing a getter-containing vacuum tube, the apparatus comprising:

a heating means for heating a getter material at a first temperature rise slope from the outside of the vacuum tube to cause flashing of the getter material; and a control means for controlling the output of said heating means to reduce the first temperature rise slope to a second temperature rise slope to obtain sufficient spattering of the getter material after reaching of the flash start temperature of the getter material.

6. The apparatus for manufacturing a getter-containing vacuum tube according to claim 5, wherein:

said heating means is a high frequency heater, and said control means controls the output of the high frequency heater after reaching of the flash start temperature of the getter material.

7. The apparatus for manufacturing a getter-containing vacuum tube according to claim 6, wherein:

said control means includes an optical sensor for detecting light generation by the flashing of the getter material, the output of the high frequency heater being controlled according to a detection output from the optical sensor.

8. An apparatus for manufacturing a getter-containing vacuum tube comprising:

heating means for heating the getter material from the outside of the vacuum tube to cause flashing of the getter material; and moving means for moving said heating means to vary the distance between said heating means and the getter material so as to reduce the temperature rise slope for obtaining sufficient spattering of the getter material after reaching of the flash start temperature of the getter material.

* * * * *